United States Patent [19]

Planesi

[11] Patent Number: 4,648,411

[45] Date of Patent: Mar. 10, 1987

[54] TOBACCO PIPE BOWL WITH ASSOCIATED HONING TOOL

[76] Inventor: Ronald D. Planesi, 5930 Clover Manor Way, Sacramento, Calif. 95824

[21] Appl. No.: 545,209

[22] Filed: Oct. 25, 1983

[51] Int. Cl.[4] ..... A24F 5/00; A24F 9/10

[52] U.S. Cl. ..... 131/226; 131/246

[58] Field of Search ..... 131/246, 222, 226, 220

[56] References Cited

U.S. PATENT DOCUMENTS 1,510,499 10/1924 Pfabe ..... 131/246

1,898,239 2/1933 Braun ..... 131/246

2,086,738 7/1937 Possinger ..... 131/246

3,023,754 3/1962 Cuchiara ..... 131/246

FOREIGN PATENT DOCUMENTS 0067078 6/1948 Denmark ..... 131/226

*Primary Examiner*—V. Millin

[57] ABSTRACT

A tobacco pipe bowl wherein the interior burning chamber is larger at its bottom base than at its top where the bowl opening is located. Furthermore, associated with the tobacco pipe bowl there is associated a honing tool to clean the tobacco pipe bowl.

3 Claims, 6 Drawing Figures

TOBACCO PIPE BOWL WITH ASSOCIATED HONING TOOL

The invention relates to a tobacco pipe bowl wherein the interior burning chamber is larger at its base than at its top where the bowl opening is located. Furthermore, also disclosed is a honing tool to clean the bowl disclosed.

DESCRIPTION OF THE PRIOR ART

Tobacco smoking pipes are generally hot to the lip, tongue, and throat, with the exception of well seasoned and "broken in" pipes. A method for "breaking in" tobacco smoking pipes during the manufacturing process has been sought for centuries, and many attempts to cool the smoke after it leaves the burn chamber have been tried.

Those skilled in the art of manufacturing and utilizing tobacco smoking pipes understand that a pipe is ordinarily "broken in" by a process of smoking small portions of tobacco until a sufficient curing process has taken place within the pipe bowl. The pipe is then smoked fully for a period of time until, eventually, an unknown process renders the emitting smoke of a few pipes "cool" to the tongue, lip, and mouth of the smoker. Various methods and explanations have been attempted in order to duplicate this unknown process and render a newly manufactured pipe into one having the characteristics and qualities of a "seasoned and broken in" pipe—allowing the smoker to forego the tedious, sometimes painful, and most often unsuccessful process of "breaking in" a new pipe.

Because the density of the packed tobacco has been said to affect the amount of heat in the smoke, U.S. Pat. No. 4,074,723 attempts to circumvent the natural process by cutting vertical air channels into the bowl interior to facilitate the access of air to the burning tobacco regardless of the density of the packed tobacco. U.S. Pat. No. 3,792,704 utilizes a pre-packed capsule with filters and an air space beneath the filter. Because the ratio of air to smoke is also said to influence the amount of heat in the emitted smoke, U.S. Pat. No. 3,791,390 utilizes a grate and finger-controlled airhole drilled through the body of the pipe bowl. Because it is generally believed that any heat or moisture conducted away from the burning chamber reduces heat in the emitted smoke, U.S. Pat. No. 3,308,834 utilizes a non-charring, non-absorbent material in combination with baffles and vents on the exterior of the pipe to conduct heat away from the bowl chamber. Similarly, U.S. Pat. No. 3,302,652 attempts to control the heat contained in the smoke and the presence of saliva through the use of a posterior air chamber and an absorbent pad filter. For similar reasons, U.S. Pat. No. 3,292,639 utilizes a corn cob insert in a heat resistant bowl, U.S. Pat. No. 3,275,006 utilizes a pre-packed capsule with a filter and a "break-away" bowl chamber for easy loading, U.S. Pat. No. 3,246,656 utilizes a closable bowl, and U.S. Pat. No. 3,230,959 utilizes an "up-side-down" burning chamber with breather holes. U.S. Pat. No. 3,323,526 utilizes a water-absorbent and water-emissive hearth at the base of the tobacco burning bowl to control the moisture content of the tobacco. These and other attempts to render a "hot" pipe into a "seasoned and broken in" pipe have all ignored the basic fact that many pipes of standard design become "cool", or moderately so, when properly "broken in". Although many explanations regarding density or thickness of wood, absence of impurities, size of bowl in relation to the size of shank hole, length of pipe shank, materials used and method of "break in" procedure, all attempts were basic circumventions of the historically unobserved fact that a well "broken in, cool" pipe invariably possesses a very particular design of relatively minute dimension within the interior furnace chamber of the bowl. The invention seeks to imitate this particular design in the manufacturing or "repair" process.

SUMMARY OF THE INVENTION

A properly designed pipe, imitative of a truely and well "broken in" pipe, under binocular microscopic view, is possessed of a smaller burning chamber at the top half of the interior bowl and a larger burning chamber at the bottom half of the interior bowl. Ideally, these two distinctly separate chambers should meet at a point where a 90 degree inverted ledge, approximately three sixteenths of one inch in depth, exists. To preclude "hot" spots, this ledge should be uniform in distance from the top and bottom of the bowl, be uniform in depth, and entirely encircle the inside of the bowl. A variety of heat ranges, from very cool to mildly warm, may be selected in the manufacturing process by varying the location and depth of the ridge to suit the individual taste of the smoker.

The relative sizes of the interior burning chambers, coupled with a shortened, inverted ledge transition area, creates an air flow pattern not unlike the Venturi tube used in an automobile carburetor. When the pipe is fully packed and lit, the air in the smaller upper chamber moves relatively faster as the smoker draws on the pipe. The "hot" air is pulled into the lower chamber, where the increased size of the chamber "slows" the air and contact with a larger material cavity as well as with the tobacco contained therein effectivly cools the smoke. The increased size of the lower chamber also allows the pipe smoker to better control the air flow, and therefore the degree of heat, in the bowl interior, much as the hydraulic brake system of an automobile allows for fine control of applied and converted physical force. This improvement in "air flow" control allows the smoker to avoid direct contact with any "hot" smoke while maintaining maximum efficiency of control over the fire within the bowl furnace.

A pipe which feels cool to the smoker from the initial puff of smoke does not encourage wetness or saliva, thus the constant problem of "wetness" common with "hot" pipes is automatically eliminated.

A secondary effect of the existence of the shortened transition point between the upper and lower chamber is that once the pipe is efficiently started, the postion of the fire within the lower chamber walls is centralized automatically when the fire passes from the smaller upper chamber to the larger lower chamber, effectively eliminating the potential "hot spots" common to pipes which burn on one side or another within the bowl interior.

DESCRIPTION OF THE PREFERRED EMBODIMENTS

Figure 1:
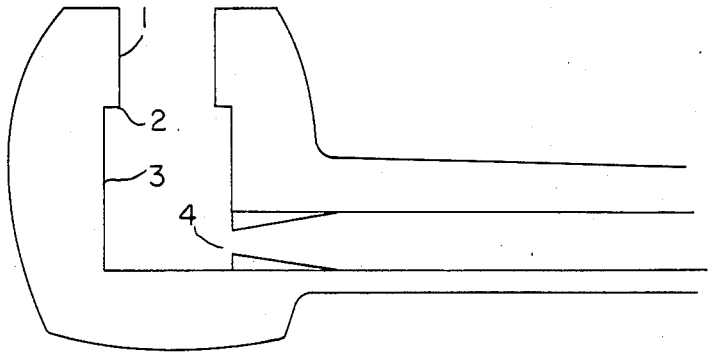
FIG. 1 is a sectional perspective view of a tobacco smoking pipe interior bowl with a larger lower furnace area and smaller upper furnace area with a shortened, inverted ledge transition area.

FIG. 1 shows a sectional perspective view of a Restricted Throat Inverted Ledge Tobacco Smoking Pipe wherein the upper furnace area (1) and lower furnace area (3) define distinct areas wherein the outer perimeter of said furnace area are substantially parallel to the central vertical axis of the furnace. The drawhole (4) is laterally positioned on an edge of the flat furnace floor. As can be seen in the drawing furnace area (1) is separated from furnace area (3) by a 90 degree inverted ledge transitional junction (2).

Figure 2:
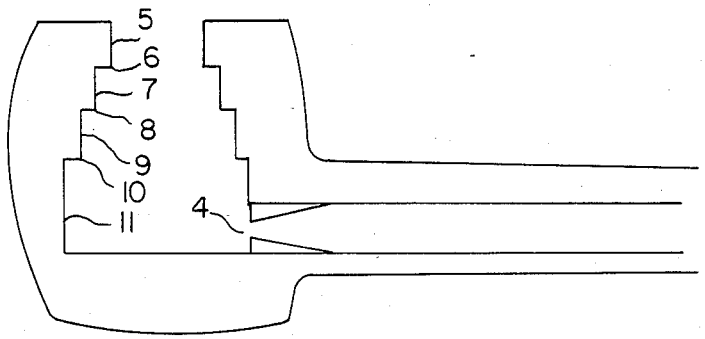
FIG. 2 is a sectional perspective view of a tobacco smoking pipe interior bowl with a multiple of increasingly larger lower furnace areas, each preceded by a shortened inverted ledge transition area.

FIG. 2 shows a sectional perspective view of a Restricted Throat, Inverted Ledge Tobacco Smoking Pipe with multiple lower furnace areas wherein the upper furnace area (5) and first lower furnace area (7) is divided by the inverted ledge transitional junction (6), the second lower furnace area (9) is divided from the first lower furnace area (7) by the second inverted ledge transitional junction (8), and the third lower furnace area (11) is divided from the second lower furnace area (9) by the third inverted ledge transitional junction (10). The drawhole (4) is laterally positioned next to the flat furnace floor.

Figure 3:
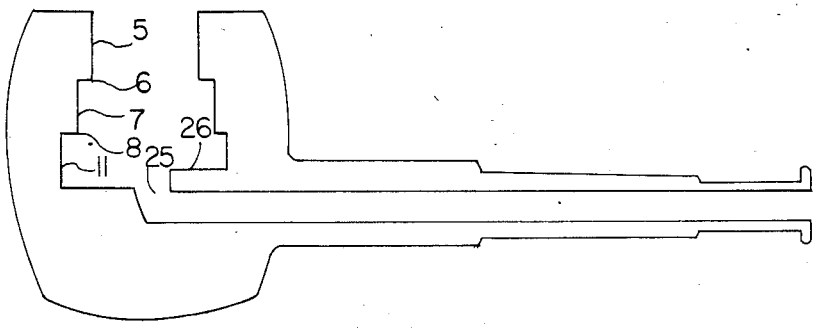
FIG. 3 is a sectional perspective view of a tobacco smoking pipe interior bowl with multiple larger lower furnace areas, each preceded by a shortened inverted ledge transition area, and a centered drawhole.

FIG. 3 shows a multiple lower furnace area Restricted Throat, Inverted Ledge Tobacco Smoking Pipe wherein furnace areas 5, 7, and 11 correspond to furnace areas 5, 7, and 11 in FIG. 2. Additionally, inverted ledge transitional junctions 6 and 8 correspond with inverted ledge transitional junctions 6 and 8 in FIG. 2. The drawhole (25), however, is centrally positioned on the flat floor (26) of the lowerst furnace area (11).

Figure 4:
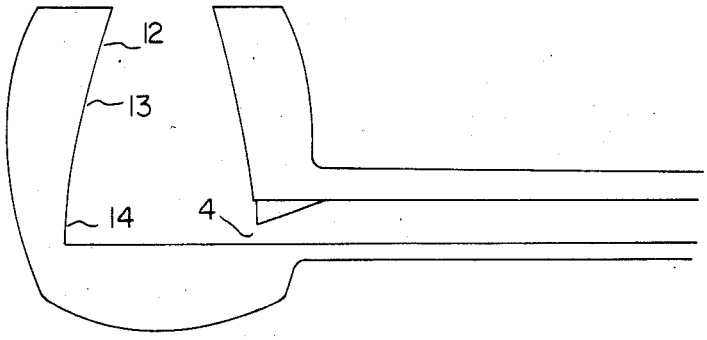
FIG. 4 is a sectional perspective view of a tobacco smoking pipe interior bowl with a larger lower furnace area and smaller upper furnace area wherein the transition between the upper and lower furnace areas is gradual and more than 90 degrees, and the floor of the furnace area is flat.

FIG. 4 shows a sectional perspective view of a Restricted Throat, Inverted Ledge Tobacco Smoking Pipe wherein the furnace walls converge symmetrically upwardly about the central vertical axis of said furnace from said flat floor to said top. As can be seen by the drawing upper furnace area (12) is divided from the lower furnace area (14) by a transitional area (13) which is more gradual and of more than 90 degrees. The draw hole (4) is laterally positioned on the flat furnace floor.

Figure 5:
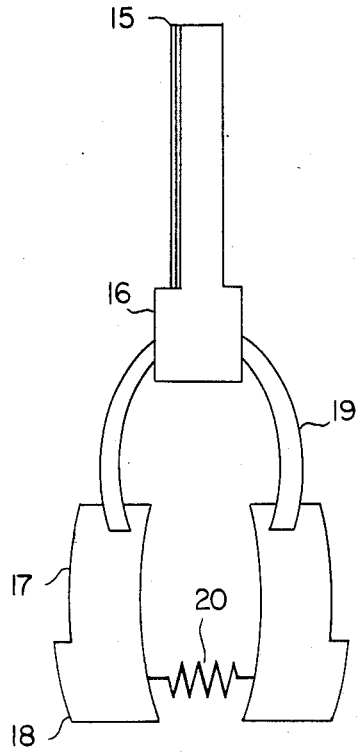
FIG. 5 is a sectional perspective view of a power reamer for a Restricted Throat, Inverted Ledge Tobacco Smoking Pipe.

FIG. 5 shows a sectional view of a honing tool for cutting a "Restricted Throat, Inverted Ledge Tobacco Smoking Pipe". The honing stone primary cutting area (18) is approximately three sixteenths of one inch wider than the secondary cutting area (17). The stone-holding arm (19) provides for flexibility, being of flexible metal, as well as providing stability for positioning of the stone. The pressure spring (20) provides for the necessary outward pressure being exerted on the cutting stones (18) during the cutting process. The junction (16) secures the stone-holding arms (19). The shank (15) is cylindrical.

Figure 6:
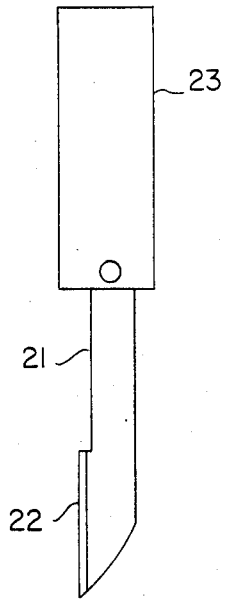
FIG. 6 is a perspective view of a hand reamer for use in a Restricted Throat, Inverted Ledge Tobacco Smoking Pipe.

FIG. 6 shows a hand reaming tool of pocket-knife like construction for cleaning a "Restricted Throat, Inverted Ledge Tobacco Smoking Pipe" wherein the primary blade area (22) is approximately three eighths of an inch long and three sixteenths of one inch wider than the two inch long secondary blade area (21). The handle (23) also functions as a sheath.

Methods of manufacture include, but are not limited to, adding material to the upper portion of the bowl chamber by means of inserts, burning specially formulated material onto the upper wall, fitting or adhering other materials to the upper portion of the pipe's interior wall, removing material from the lower portion of the bowl chamber by cutting, grinding, or burning, and the use of pre-manufactured capsules that conform in design to the concepts of the invention.

What I claim as new and desire to secure by Letter of Patent of the United States is:

1. A tobacco pipe bowl cleaner comprising a shank having a plurality of honing stones attached to said shank by flexible arms, said stones having a pressure spring connecting said stones wherein said spring exerts a pressure on said stones such that the stones are pressed outwardly.

2. A tobacco pipe including a pipe stem; a bowl having a furnace chamber therein; said furnace chamber having a central vertical axis; an opening at the top of said bowl for the insertion of said tobacco into said furnace; said furnace having a flat furnace floor located at the bottom of said furnace; a draw hole laterally positioned on an edge of said flat furnace floor so as to provide fluid communication between said furnace chamber and said pipe stem; said furnace having a plurality of distinct furnace areas arranged along the central vertical axis of said furnace wherein said distinct areas get larger in a step wise manner as you travel down the vertical axis from said top to said floor and the outer perimeter of said furnace areas are substantially parallel to said central vertical axis.

3. A tobacco pipe including a pipe stem; a bowl having a furnace chamber therein; said furnace chamber having a central vertical axis; an opening at the top of said bowl for the insertion of said tobacco into said furnace; said furnace having a flat surface floor located at the bottom of said furnace; a draw hole laterally positioned on an edge of said flat furnace floor so as to provide fluid communication between said furnace chamber and said pipe stem; said furnace walls converging upwardly about the central vertical axis of said furnace from said flat floor to said top wherein the furnace area continuously gets larger as you travel down the central vertical axis of said furnace.

* * * * *